United States Patent [19]

Bender et al.

[11] Patent Number: 4,714,456

[45] Date of Patent: Dec. 22, 1987

[54] SOLID BOWL CENTRIFUGE WITH TERMINAL CLARIFICATION DEVICE

[75] Inventors: Wolfgang Bender; Dieter Mrotzek, both of Burscheid; Bernd Koglin, Bergisch Gladbach; Karl-Heinz Steiner, Cologne, all of Fed. Rep. of Germany

[73] Assignee: Bayer Aktiengesellschaft, Leverkusen, Fed. Rep. of Germany

[21] Appl. No.: 860,713

[22] Filed: May 7, 1986

[30] Foreign Application Priority Data

May 25, 1985 [DE] Fed. Rep. of Germany ..... 3518885

[51] Int. Cl.[4] ..... B04B 7/16

[52] U.S. Cl. ..... 494/36; 494/53

[58] Field of Search ..... 494/36, 52, 53, 54, 494/55, 56, 57, 58, 27, 28, 29, 23, 25; 210/781, 782, 360.1, 365, 366

[56] References Cited

U.S. PATENT DOCUMENTS

| | | | |
|---|---|---|---|
| 3,501,346 | 3/1970 | Katzen | 494/53 |
| 3,885,734 | 5/1975 | Lee | 494/53 |
| 4,009,823 | 3/1977 | Nozdrovsky | 494/53 |
| 4,209,128 | 6/1980 | Lyons | 494/53 |
| 4,334,647 | 6/1982 | Taylor | 494/53 |
| 4,496,340 | 1/1985 | Redeker | 494/29 |

*Primary Examiner*—Robert W. Jenkins

*Attorney, Agent, or Firm*—Sprung Horn Kramer & Woods

[57] ABSTRACT

The solid bowl screw centrifuge consists of a housing (1) in which a drum (2) is rotatable. A rotatably mounted conveyor screw (3) is situated inside the drum (2). The drum (2) and screw (3) rotate at slightly differing speeds of rotation when in operation. The housing (1) is cylindrical in the region of the clarifying part (I) and conical in the region of the demoisturizing part (II). The suspension inflow (5,6) opens into the hollow screw core (12) at a location between the clarifying part (I) and the demoisturizing part (II). The liquid discharge consists of an overflow weir (16) or stripping pipe (9) on the clarifying part (I). The solids discharge (4) is situated at the end of the demoisturizing part (II). The screw (3) is arranged within the clarifying part (I) on the cylindrical hollow screw core (12) whose peripheral surface is partly or completely equipped with an after-clarifying device through which fluid flows in a radial direction. The after-clarifying device consists either of a filtration device placed on the perforated screw core (12) or of a laminar separator (14). These fittings enable the degree of separation of the centrifuge to be improved, especially in the treatment of solids which sediment only slowly.

5 Claims, 2 Drawing Figures

SOLID BOWL CENTRIFUGE WITH TERMINAL CLARIFICATION DEVICE

BACKGROUND OF THE INVENTION

This invention relates to a solid bowl screw centrifuge comprising a cylindrical clarifying part, a conical demoisturizing part, a single flight or multiple flight, leading or trailing ribbon or solid blade screw, a suspension inflow opening into one end of the clarifying part or between the clarifying part and the demoisturizing part, a liquid discharge in the form of an overflow weir or stripping pipe on the clarifying part and a solids discharge on the demoisturizing part.

Centrifuges of this type (also known as decanters) are used in processing technology for separating the solid and liquid phase of suspensions. Separation is obtained by the solid being thrown outwards as sediment by the centrifugal force while in the conical/cylindrical rotating drum a screw rotating at a slightly different speed conveys the deposited solid to the discharge at the demoisturizing part. For further details, see the literature (e.g. Ullmanns Encyclopädie der Technischen Chemie, Volume I, 3rd Edition, 1951; F. Ch. Alt, W. Gösele, Einsatzkriterien für Dekanter, Chem.-Ing.-Techn. 54 (1982)5, 425–430; W. Stahl, Th. Langeloh: Zur Verbesserung der Klärung in Dekantierzentrifugen, Chem.-Ing.-Techn. 55 (1983)4, 324–325; DE-OS 2 321 653; GM 1 760 883).

If the solid particles in suspensions sediment only slowly because they are very small or because there is very little difference between their density and that of the liquid, or if the solid sedimented from a suspension is thrown up again by the screw or by the overflow, then complete separation of the solid substance cannot be obtained at economical rates of throughput in a solid bowl screw centrifuge. There have long been attempts to improve the separation results, for example by modifying the transport of the suspension or liquid. Laminar fittings through which suspensions flow in an axial direction have been developed for the same purpose and/or the screw flights in the cylindrical clarifying part have been specially designed with this end in view (e.g. ribbon screws or screws with variable pitch). In spite of these measures, however, complete separation is in many cases impossible to achieve. It is at this point that the invention sets in.

SUMMARY OF THE INVENTION

It is an object of the present invention to improve the degree of separation in a solid bowl screw centrifuge of the type defined above by providing special fittings.

To solve this problem according to the invention, the screw is attached in the cylindrical clarifying part to a cylindrical hollow screw core whose surface is partly or completely fitted with an after-clarifying device through which fluid flows in a radial direction, and the liquid discharge is arranged directly on or within the screw core.

The after-clarifying device preferably consists of a filtration device placed on the perforated screw core.

Alternatively, the after-clarifying device may consist of a laminar separator with a plurality of obliquely placed lamellae arranged parallel to one another on the core of the screw. A backwash discharge is preferably provided at the end of the clarifying part. This backwash discharge is preferably in the form of a siphon which automatically opens periodically when the centrifuge is in operation.

The following advantages are achieved by means of the invention:

1. Due to the fact that liquid is drawn off along the whole cylindrical part of the drum, the flow velocity to the overflow is substantially reduced so that even solid substances which are very readily stirred up again can be separated by sedimentation.
2. Any particles which have failed to be separated in spite of the improved sedimentation are finally deposited on the surface of the filtration device on the core of the screw as the preclarified liquid is drawn off by flowing inwardly through the core of the screw. In order to prevent blockage of the filtration device by the fine particles deposited there when the apparatus is in constant operation, means must be provided for periodic backwashing. In simple cases, interrupting the inflow of suspension is sufficient to enable the agglomerations of particles on the filtration device to be thrown outwards.

The invention will now be described in more detail with reference to exemplary embodiments illustrated in the drawings, in which

DETAILED DESCRIPTION OF THE INVENTION

Figure 1:
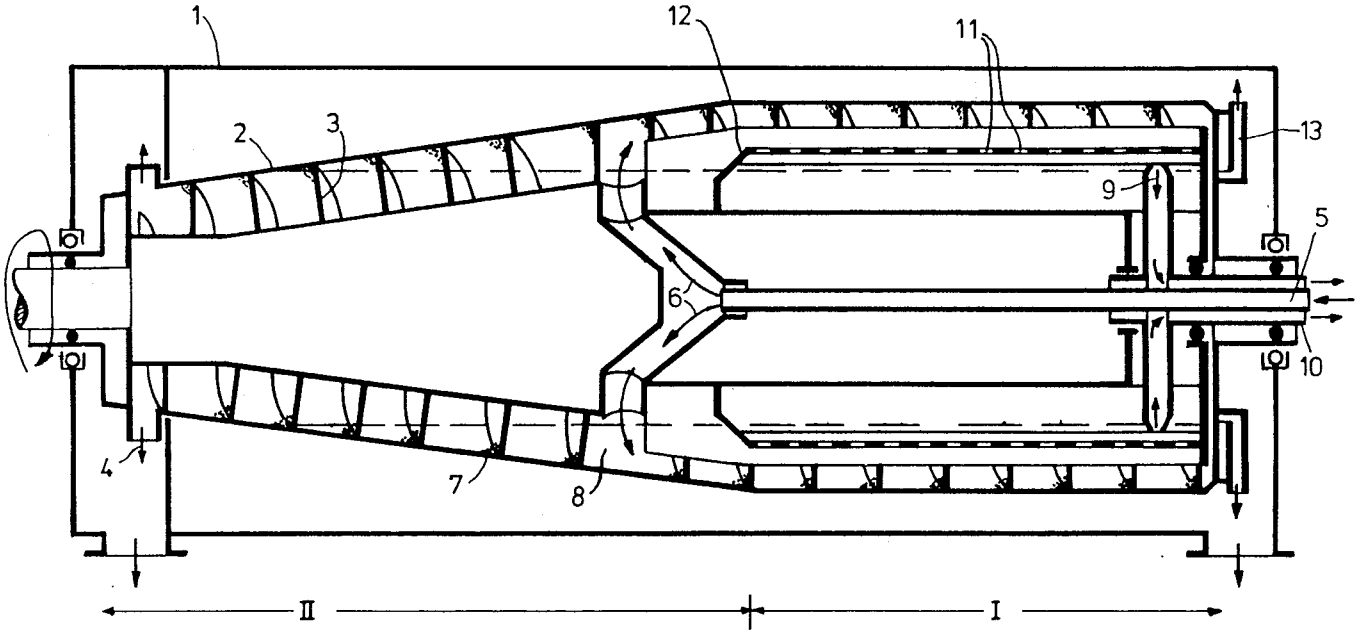
FIG. 1 shows a solid bowl screw centrifuge with internal filter and backwashing siphon and FIG. 2 shows a solid bowl screw centrifuge with a laminar separator as an after-clarifying device.

According to FIG. 1, a drum 2 is rotatably mounted in a housing 1. A rotatably arranged conveyor screw 3 is situated inside the drum 2. The drum 2 and screw 3 rotate at slightly differing speeds so that there is a slight frequency difference between the drum and the screw.

The drum 2 and screw 3 taper conically towards the solids discharge 4 (demoisturizing part II). At the other end, the drum and the screw are cylindrical (clarifying part I). The suspension from which the solid phase is required to be separated enters the centrifuge chamber through the axial suspension inflow 5 which extends approximately to the boundary between the clarifying part I and demoisturizing part II (arrow 6). The solid 7, which has a higher specific gravity, is thrown outwards and is transported to the solids discharge 4 by the relative movement between the drum 2 and the screw 3, while the liquid phase forms the sump 8. The clarified liquid (filtrate) is drawn off in the clarifying part by means of a stripping pipe 9 and discharged from the centrifuge through a pipe 10 which is concentric with the suspension inflow 5.

In order to ensure that particles which do not easily sediment will be kept out of the filtrate, an after-clarifying device is provided in the clarifying part I in a position in front of the stripping pipe 9, viewed in the direction of flow. This after-clarifying device consists of a perforated filter drum 12 (with perforations 11) which at the same time constitutes the core of the screw in the clarifying part I. The filter drum 12 is covered with a suitable filtration device, e.g. a filter cloth. The stripping pipe 9 is situated within the filter drum 12, as already mentioned above. The circumferential surface of the filter drum 12 may be subdivided into individual filter elements, e.g. filter pockets. The filtration device is required to be cleaned from time to time to prevent blockage. An arrangement for backwashing the filter is provided for this purpose. This backwashing may be obtained by stopping the supply of suspension when the liquid in the drum 12 reaches a certain level and at the same time supplying backwashing fluid (filtrate) from the filtrate side. The normal removal of filtrate by means of the stripping pipe 9 is stopped during this operation. The liquid which then flows backwards through the filtration device to the waste weir at the end face washes off any fine particles in the filtration device.

Alternatively, backwashing may be achieved by constructing the overflow at the end face of the cylindrical part of the drum 2 as an automatic siphon 13.

The siphon overflow is in this case situated slightly within the level of the stripping pipe, as shown in FIG. 1. A backwashing arrangement of this kind provides for rapid emptying of the drum 2 with more powerful backwashing of the filter, provided the filtrate is discharged at such a radius that sufficient liquid can accumulate within the core of the screw. If desired, an adjustable stripping device could be used instead of the backwashing siphon 13. With such an arrangement, the operation of backwashing could easily be initiated whenever desired, e.g. at periodic intervals, while the suspension inflow is closed. Moreover, such an arrangement would provide the advantage that the sump (residual volume of liquid) could be removed before the centrifuge is brought to a standstill.

Figure 2:
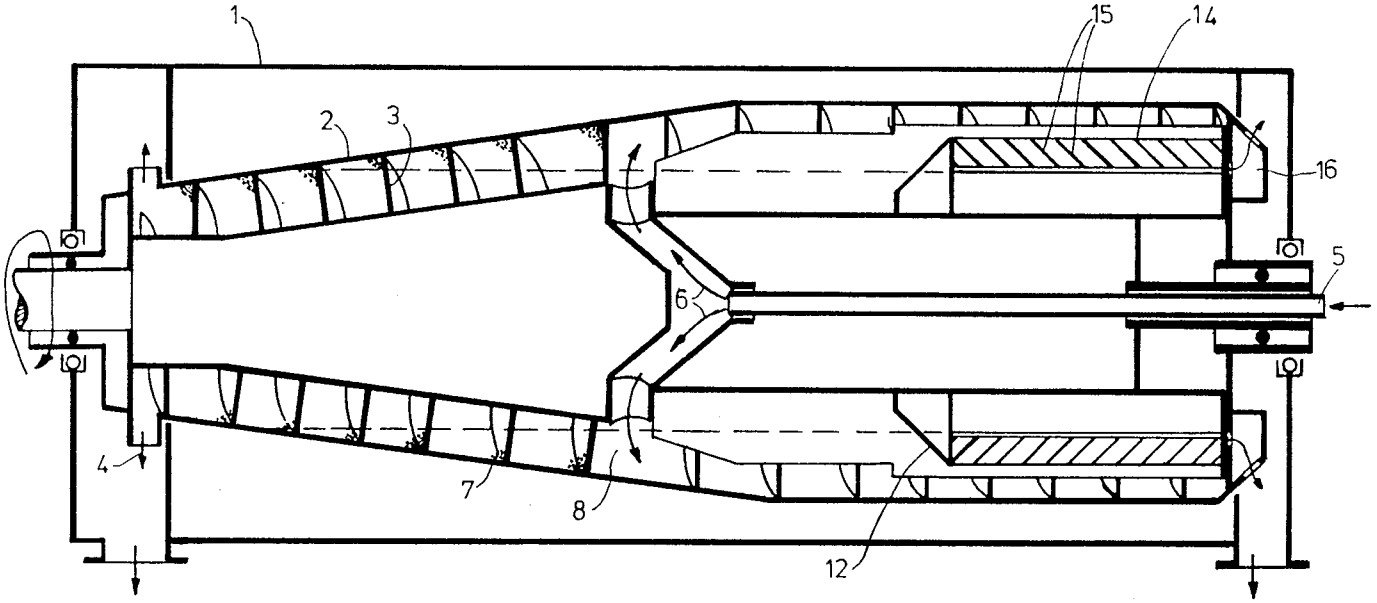

The solid bowl screw centrifuge shown in FIG. 2 is in principle similar in construction to the centrifuge of FIG. 1 but the after-clarifying device in the cylindrical clarifying part I in this case is not a filter but a laminar separator 14. This laminar separator 14 is formed by a plurality of parallel lamellae 15 arranged obliquely on the core of the screw. These separator lamellae 15 may be mounted on the screw core 12 at intervals of e.g. 1 mm at an angle of inclination of 30° to 60°. The packet of lamellae has much the same effect as a static laminar separator or disc separator. The particles which are deposited in the lamellae 15 are thrown back into the drum as a continuous layer as soon as they have formed or exceeded a layer of a certain thickness. In the centrifuge of FIG. 2, the discharge for clarified liquid is in the form of an adjustable overflow weir 16.

As to which after-clarifying device should be selected (filtration device or laminar separator), this will depend primarily upon the particular system of substances to be separated. If there is only a slight difference in density between the solid and the liquid, the filter system would be preferable for after-clarification, but for greater density differences the method of after-clarification with lamellae would appear to be superior. For very fine particles which are difficult to wash out of the filtration device by backwashing, additional filtration devices, e.g. based on cellulose, may be provided. Their density, however, should be lower than or at the most equal to that of the suspension.

We claim:

1. In a solid bowl screw centrifuge having a cylindrical clarifying part, a conical demoisturizing part, a screw, means mounting the screw in the two parts for rotation, a suspension inflow opening into the end of the clarifying part between the clarifying part and the demoisturizing part, a liquid discharge including an overflow weir or a stripping pipe on the clarifying part and a solids discharge on the demoisturizing part, the improvement wherein the means mounting the screw in the cylindrical clarifying part comprises a cylindrical hollow screw core having a peripheral surface at least partly comprising an after-clarifying device through which fluid flows in a radial direction, and wherein the liquid discharge is situated within the after-clarifying device.

2. The solid bowl centrifuge according to claim 1, wherein the after-clarifying device comprises perforations in the peripheral surface of the screw core and a filtration device placed on the perforated screw core.

3. The solid bowl centrifuge according to claim 1, wherein the after-clarifying device comprises a laminar separator comprising a plurality of parallel lamellae mounted obliquely on the screw core.

4. The solid bowl centrifuge according to claim 1, further comprising means forming a backwash discharge at one end of the clarifying part.

5. The solid bowl centrifuge according to claim 4, wherein the means forming the backwash discharge comprises a siphon which automatically empties at periodic intervals while the centrifuge is in operation.

* * * * *